United States Patent [19]

Reinhall

[11] 3,974,971

[45] Aug. 17, 1976

[54] GRINDING DISCS FOR DEFIBERING FIBROUS MATERIAL

[76] Inventor: Rolf Bertil Reinhall, Killingevagen 16, 181 64 Lidingo, Sweden

[22] Filed: Mar. 6, 1975

[21] Appl. No.: 556,145

Related U.S. Application Data

[63] Continuation of Ser. No. 347,571, April 3, 1973, abandoned.

[30] Foreign Application Priority Data

Apr. 13, 1972 Sweden ..... 4819/72

[52] U.S. Cl. ..... 241/261.3; 51/209 R; 51/293

[51] Int. Cl.[2] ..... B02C 13/20

[58] Field of Search ..... 51/293, 209 R, 206.4, 51/206, 356, 309; 241/261.1, 261.2, 261.3, 296, 300

[56] References Cited

UNITED STATES PATENTS

| | | | |
|---|---|---|---|
| 1,269,762 | 6/1918 | Warner | 51/293 |
| 1,306,610 | 6/1919 | Morgan | 51/293 |
| 2,334,642 | 11/1943 | Moore | 51/356 |
| 2,577,937 | 12/1951 | Waldron et al. | 51/209 R |
| 2,989,826 | 6/1961 | Lamesch | 51/209 R |
| 3,068,618 | 12/1962 | Lamesch | 51/209 R |
| 3,459,379 | 8/1969 | Brown | 51/356 |
| 3,539,315 | 11/1970 | Bidwell | 51/293 |

FOREIGN PATENTS OR APPLICATIONS

| | | | |
|---|---|---|---|
| 373,617 | 5/1932 | United Kingdom | 51/309 |
| 6,128 | 4/1912 | United Kingdom | 51/293 |

*Primary Examiner*—Donald J. Arnold
*Attorney, Agent, or Firm*—Eric Y. Munson

[57] ABSTRACT

Grinding discs in apparatus for manufacture of pulp composed of a support disc and segments mounted on said support disc so as to form a ring. The segments are formed with ribs and grooves for breaking down the material to be ground. The outer and inner peripheral edges form together common edge lines following a wave-shaped contour line. The invention also includes a method of manufacturing segments which when annularly mounted on a support disc present wave-shaped common outer and inner peripheral edge lines.

1 Claim, 3 Drawing Figures

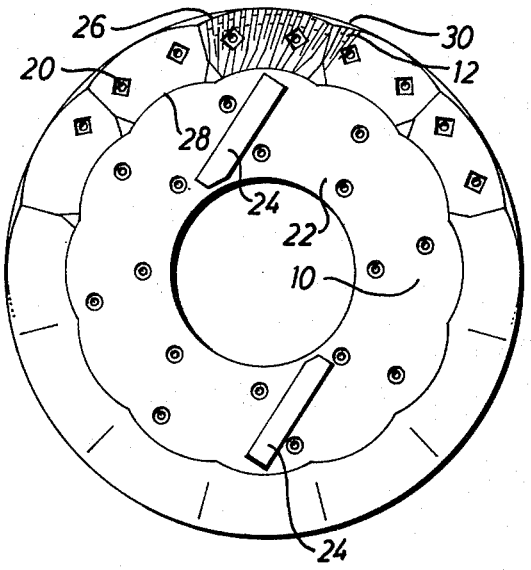
Fig. 1
Fig. 3
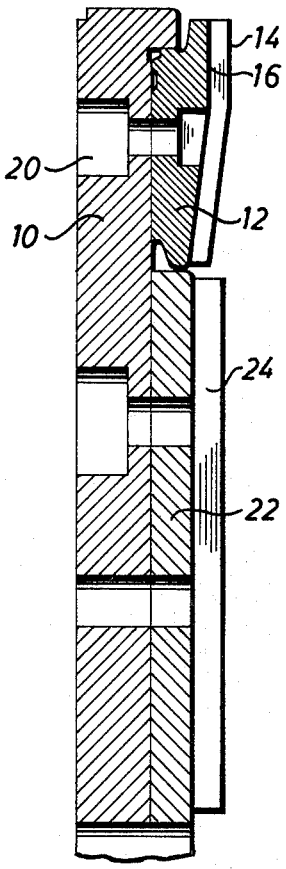
Fig. 2
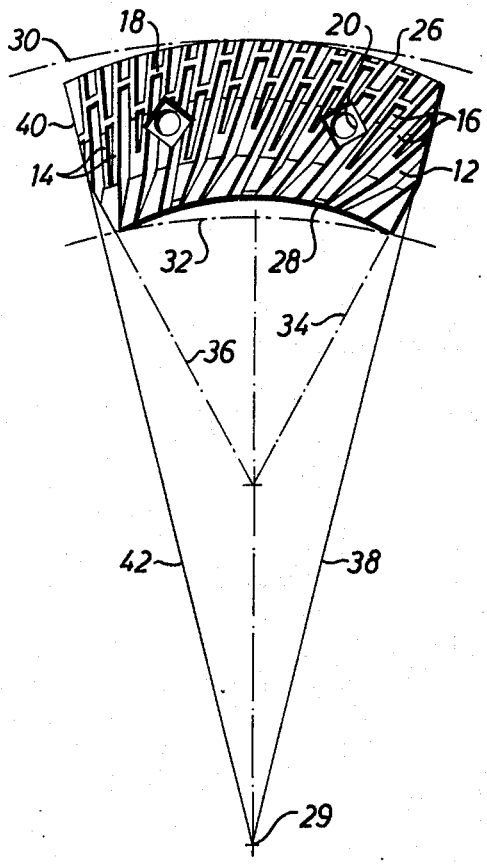

GRINDING DISCS FOR DEFIBERING FIBROUS MATERIAL

This is a continuation of application Ser. No. 347,571, filed 4-3-73, and now abandoned.

FIELD OF THE INVENTION

This invention relates to a device in or relating to grinding discs and process of manufacturing the same.

BACKGROUND OF THE INVENTION

More particularly this invention relates to grinding discs composed of a support disc and segments annularly mounted thereon and provided with grooves and ribs for breaking down the material to be ground. Especially the grinding discs embodying the invention are intended to form part of grinding machines for defibering or refining lignocellulose or fibrous materials.

THE PRIOR ART

In the grinding machine two co-operating grinding discs perform a rotational movement relative one another, the grooves and ribs extending outwards from a shorter to a greater radius and in most cases having concentric fillets or transverse ridges. The objective of these means is to bring about a pulsation of the material to be ground during the mechanical separation of the fibers from one another and the uncovering of the fibrilles of the material.

OBJECTS AND MAIN FEATURES OF THE INVENTION

The principle object of the invention is to further increase the grinding effect by the novel feature that both the outer and the inner peripherial edges of the grinding segments have a radius of curvature lesser than the corresponding radii calculated from the center of rotation of the support disc so as to cause the common edge lines of the segments to follow a wave-shaped contour line.

SUMMARY OF THE INVENTION

The design at the inner periphery of the segments in the form of curves or waves produces during the relative rotational movement of the two grinding discs regularly reiterating variations in pressure of considerably lower frequency but with higher differences in the pressure than are obtained with the conventional grooves and ribs formed on the grinding surfaces of the segments. The arrangement of curves or waves at the outer periphery of the grinding disc also produces variations in pressure, due to the relative rotational movement between the two grinding discs, which variations also are substantial and have a relatively low frequency compared with those produced at the inner end edges of the grinding segments. This is of especial advantage when the grinding takes place in so called closed refiners which results in the accumulation of the ground produce in a casing enclosing the grinding discs. These differences or variations in pressure have a favourable effect on the material to be ground during its passage through the grinding space between grinding segments by subjecting the material while being ground to additional agitation which promotes the separation of the fibers from one another and/or the uncovering of the fibrilles.

Further objects and advantages of the invention will become apparent from the following description of an embodiment shown by way of example in the accompanying drawing, which forms part of this specification and of which:

BRIEF DESCRIPTION OF THE DRAWINGS

FIG. 1 is a side view of a grinding disc constructed in accordance with the invention.

FIG. 2 is a side view on an enlarged scale of a segment.

FIG. 3 is a cross-sectional view of a portion of the grinding disc shown in FIG. 1 and represented in FIG. 3 in a still more enlarged scale.

DESCRIPTION OF PREFERRED EMBODIMENT

Referring to the drawing, reference numeral 10 denotes a support disc which may be mounted rotatively or stationarily in a grinding apparatus. At its outer periphery the disc carries grinding segments 12 assembled side by side and in known manner formed with ribs 14 extending obliquely outwards in radial direction and separated from one another by grooves 16. The grooves 16 may be interrupted by peripheral dams or transverse ribs 18. The segments are mounted on the disc 10 by means of screw connections (not shown) disposed in recesses 20 formed in the disc and the segments. Mounted inside of the ring of segments may be one or several discs 22 provided with conveyor members 24 which assist in the feeding the material to be ground from a central supply opening into the grinding space between two cooperating grinding discs. The disc 22 is rigidly mounted on the larger support disc 10 in the same manner as are the segments 12.

According to the invention, both the outer and the inner peripheral edges 26 and 28, respectively, of the segments 12 have a radius of curvature which is lesser than their spacing from the center of rotation 29 of the support disc 10. Imaginary circular lines about this center are indicated in FIG. 2 at 30 and 32, and it will become evident that the segments together form outer and inner contour lines of wave-shape about the circumference.

The segments 12 are manufactured from annular disc blanks which have a shorter diameter than that which corresponds to the location of the segments on the disc 10. Said disc blanks are formed with ribs 14, 18 and grooves 16 about their circumferences. Thereupon each disc blank is cut into segments along the radii 34 and 36. The radial edges of the segments are thereupon adjusted to the greater radius along which the segments are assembled and mounted on the disc 10. In this connection it would be noted that the original edge line of the segments corresponding to the radii 34 and 36 along a smaller inner portion of the segments may be retained. Outside this inner portion the segments are worked so as to cause their edge lines 40 to coincide with radii 38 and 42, respectively, extending from the center of rotation 29. In this way the quantity of material which is lost by this working is reduced to a minimum. As example may be mentioned that if the number of segments assembled about the circumference of the disc 10 according to the invention is twelve, the segments may be cut from two annular discs having slightly more than half the diameter of the final outer diameter of the segments.

OPERATION OF GRINDING DISCS ACCORDING TO THE INVENTION

Coaxially mounted within the casing of the grinding machine are two grinding discs forming therebetween a grinding space which is defined by the segments 12 of the grinding discs and which in most cases has such a narrow width as some hundredths of one millimeter. One of the discs may be mounted for rotation and the other stationary or both may rotate e.g. in mutually opposite directions. During the relative rotational movement the segments of the two grinding discs which preferably are of the same shape and arranged on the same radius to pass one another in such a manner that the segments of one of the discs with its projecting wave shaped middle portions will alternatively face the grooves of the central portions of the segments of the other grinding disc. In this manner the grinding produce is subjected to radial forces which vary in frequency and magnitude in response to the wave-shape. Obviously, the frequency becomes less while at the same time the force becomes many times greater than that which is produced by the grooves and ribs distributed over the individual grinding segments. According to the invention, a substantially improved grinding effect is obtained by the great pulsating pressure variations to which the material is subjected while being passed in outward direction through the grinding space between two cooperating rings of grinding segments.

In the same manner, the specific shape of the grinding members according to the invention is especially suited for pure defibration of chemically pretreated fibre pulps, e.g. in the defibration of digested pulp coming from a cellulose cooker prior to the steps of washing and screening where a highly advanced separation of the pulp into individual fibres can be brought about, if desired, without any appreciable mechanical working and subsequent swelling (hydration) of the fibrous product.

The hydration of the fibrous product which is caused by too powerful mechanical working or treating has an unfavourable effect on the capacity in subsequent washing systems by substantially increasing the resistance of the material to throughflow of liquid.

While one more or less specific embodiment of the invention has been shown and described, it is to be understood that this is for purpose of illustration only and that the invention is not to be limited thereby, but its scope is to be determined by the appended claims.

What is claimed is:

1. A grinding disc for defibering fibrous material in an interspace between two opposed relatively rotating discs comprising:

a. a circular plate mounted for rotational movement;

b. an opening located at the center of said plate for introducing the material into a central feeding section;

c. a plurality of arcuate grinding segments having radially extending edges disposed peripherally about said plate and extending inwardly from the outer periphery of the segment to an inner periphery thereof which merges with said feeding section;

d. said grinding segments having a grinding face comprising a plurality of spaced ribs with intervening material flow channels extending obliquely from the inner periphery to the outer periphery of the segments; and e. the outer and inner peripheries of said segments both having a radius of curvature which is shorter than the dimension of the spacing of said segment inner periphery from the center of said plate opening to cause the outer and inner peripheries of the adjoining segments to define scalloped peripheral edges forming a wave-shape about the disc circumferenceso that thetwoopposed relatively rotating discs subject fibrous material therebetween to radial forces which vary in frequency and magnitude in response to the wave-shape producing pulsating pressure variations resulting in improved defibration.

* * * * *